US008070530B1

(12) United States Patent
Kobayashi et al.

(10) Patent No.: US 8,070,530 B1
(45) Date of Patent: Dec. 6, 2011

(54) MODULAR JACK

(75) Inventors: Katsumi Kobayashi, Tokyo (JP); Hirofumi Asoh, Tokyo (JP); Nobuo Takagi, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/106,381

(22) Filed: May 12, 2011

(30) Foreign Application Priority Data

Jun. 4, 2010 (JP) ..... 2010-129198

(51) Int. Cl.
*H01R 24/00* (2011.01)

(52) U.S. Cl. ..... 439/676

(58) Field of Classification Search ..... 439/676, 439/679, 941, 459–465, 450, 620.11, 620.17, 439/620.18, 620.23; 174/660
See application file for complete search history.

(56) References Cited

U.S. PATENT DOCUMENTS

| | | | | |
|---|---|---|---|---|
| 5,790,660 | A | 8/1998 | Vlaeminck | |
| 6,012,936 | A * | 1/2000 | Siemon et al. | 439/188 |
| 6,017,229 | A * | 1/2000 | Tulley et al. | 439/144 |
| 6,296,527 | B1 * | 10/2001 | Zhang et al. | 439/676 |
| 6,331,126 | B1 * | 12/2001 | Wagner | 439/676 |
| 6,354,884 | B1 * | 3/2002 | Yeh et al. | 439/680 |
| 6,368,158 | B1 * | 4/2002 | Kan | 439/676 |
| 6,579,128 | B1 * | 6/2003 | Wu | 439/676 |
| 6,926,558 | B2 | 8/2005 | Sasai et al. | |
| 2002/0177369 | A1 * | 11/2002 | Hyland | 439/676 |
| 2004/0209522 | A1 | 10/2004 | Chang | |

FOREIGN PATENT DOCUMENTS

| | | |
|---|---|---|
| JP | A-9-129294 | 5/1997 |
| JP | U-3103961 | 6/2004 |
| JP | A-2004-186099 | 7/2004 |

* cited by examiner

*Primary Examiner* — Tulsidas C Patel
*Assistant Examiner* — Harshad Patel
(74) *Attorney, Agent, or Firm* — Oliff & Berridge, PLC

(57) ABSTRACT

A downsized modular jack with high surface-mounting performance. The modular jack has a housing and a terminal holder assembled thereto. The housing has a rear wall formed with a terminal insertion through-hole extending through a thickness of the rear wall, and a latch section insertion through-hole positioned beside the terminal insertion through-hole. The latch section insertion through-hole has an engaged portion positioned within the thickness of the rear wall. The terminal holder has a connector terminal extending through the terminal insertion through-hole and a latch section engaged with the engaged portion and positioned within the thickness of the rear wall upon assembly of the terminal holder into the housing.

9 Claims, 4 Drawing Sheets

MODULAR JACK

CROSS REFERENCE TO RELATED APPLICATION

This application claims priority from Japanese Patent Application No. 2010-129198 filed Jun. 4, 2010. The entire content of the priority application is incorporated herein by reference.

TECHNICAL FIELD

The present invention relates to a modular jack, and more particularly, to an engagement structure between plurality of parts and components those constituting the modular jack.

BACKGROUND

An electrical equipment such as a television is provided with a modular jack (modular connector) to which a LAN cable is connected for data transmission. Japanese Patent Application Publication No. H09-129294 discloses a modular jack having a main body and a terminal module assembled thereto. A connector of a LAN cable is inserted into the main body, and the terminal module includes terminals to be connected to the connector.

SUMMARY

According to the disclosed modular jack, a side wall portion of the main body has an outer side provided with an engagement portion for engagement with the terminal module, and the side wall portion is resiliently deformed for connection between the main body and the terminal module. With this structure, widthwise dimension of the modular jack is increased due to the engagement portion provided at the outer side of the side wall portion, thereby degrading surface-mounting performance.

Therefore, it is an object of the present invention to provide a compact modular jack capable of improving a surface-mounting performance.

This and other object of the present invention will be attained by providing a modular jack including a housing and a terminal holder assembled thereto. The housing includes a bottom wall, a top wall in confrontation with the bottom wall, a first side wall extending between the bottom wall and the top wall, a second side wall extending between the bottom wall and the top wall and in confrontation with the first side wall, and a rear wall extending between the bottom wall and the top wall and between the first side wall and the second side wall. A connector accommodation space is defined by the bottom wall, the top wall, the first side wall, the second side wall and the rear wall. The terminal holder includes a connector terminal and a latch section. The connector terminal includes a plurality of terminals extending in parallel to each other and arrayed side by side in an arraying direction. The latch section is positioned at one end of the connector terminal in the arraying direction. The rear wall has an inner surface defining the connector accommodation space, and an outer surface opposite to the inner surface. The rear wall is formed with a terminal insertion through-hole communicating the inner surface with the outer surface, and a latch section insertion through-hole positioned beside the terminal insertion through-hole in the arraying direction and close to the one of the first side wall and the second side wall. The latch section insertion through-hole is provided with an engaged portion positioned between the inner surface and the outer surface.

Upon assembly of the terminal holder to the housing, the connector terminal extends through the terminal insertion through-hole and is exposed to the connector accommodation space, and the latch section is engaged with the engaged portion.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
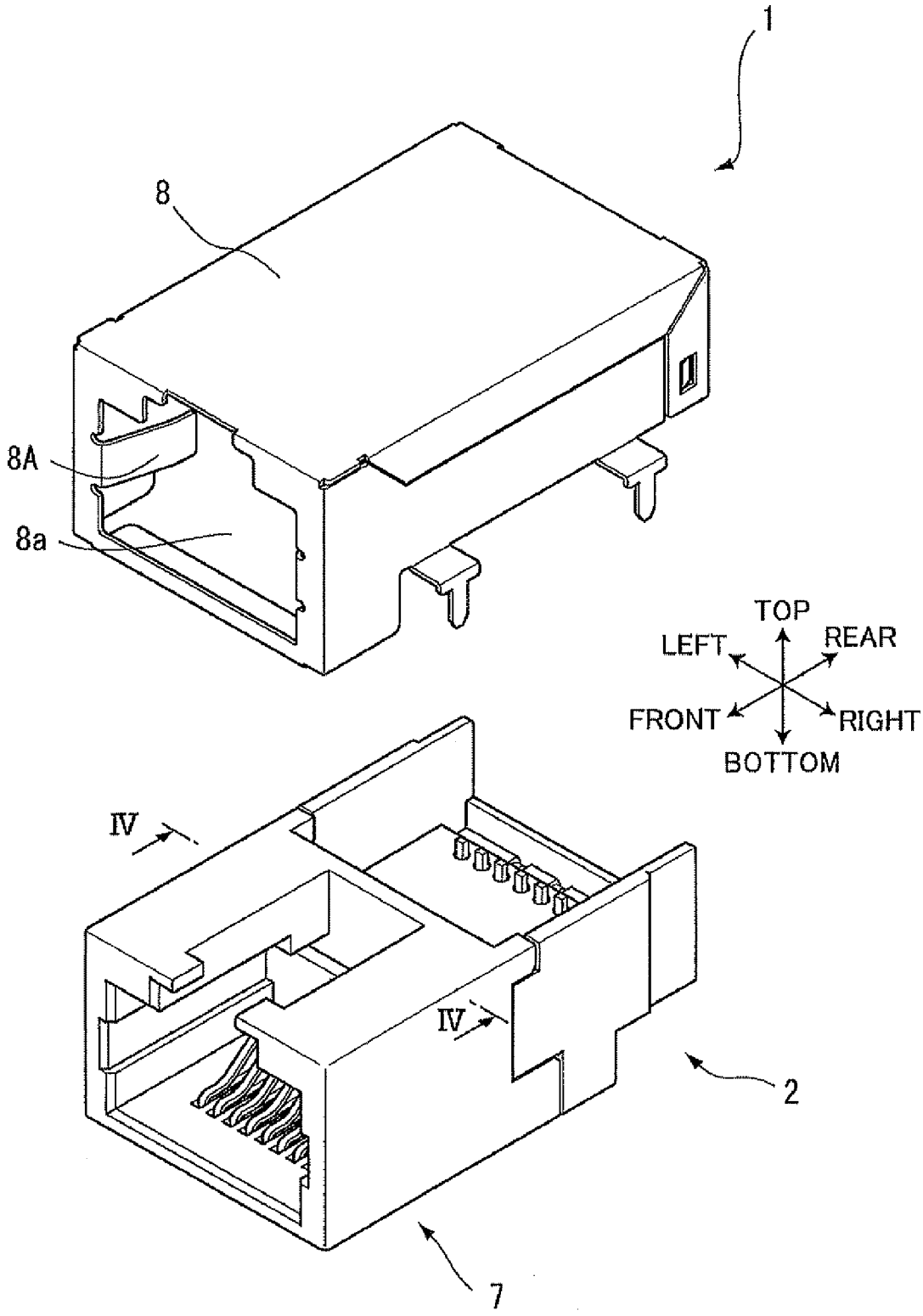
FIG. 1 is an exploded perspective view of a modular jack according to one embodiment of the present invention.

A modular jack according to one embodiment of the present invention will be described with reference to FIGS. 1 through 6. The modular jack 1 shown in FIGS. 1 and 2 includes a housing 7 as a connector receiving portion, a circuit portion 2 as a terminal holder, and a frame 8. The frame 8 covers the circuit portion 2 and housing 7 while the circuit portion 2 is assembled to the housing 7. In the following description, the housing 7 side in FIG. 2 will be referred to as a "front side", and the circuit portion 2 side will be referred to as a "rear side," and a direction between the front side and the rear side will be referred to as a "frontward/rearward direction".

Figure 2:
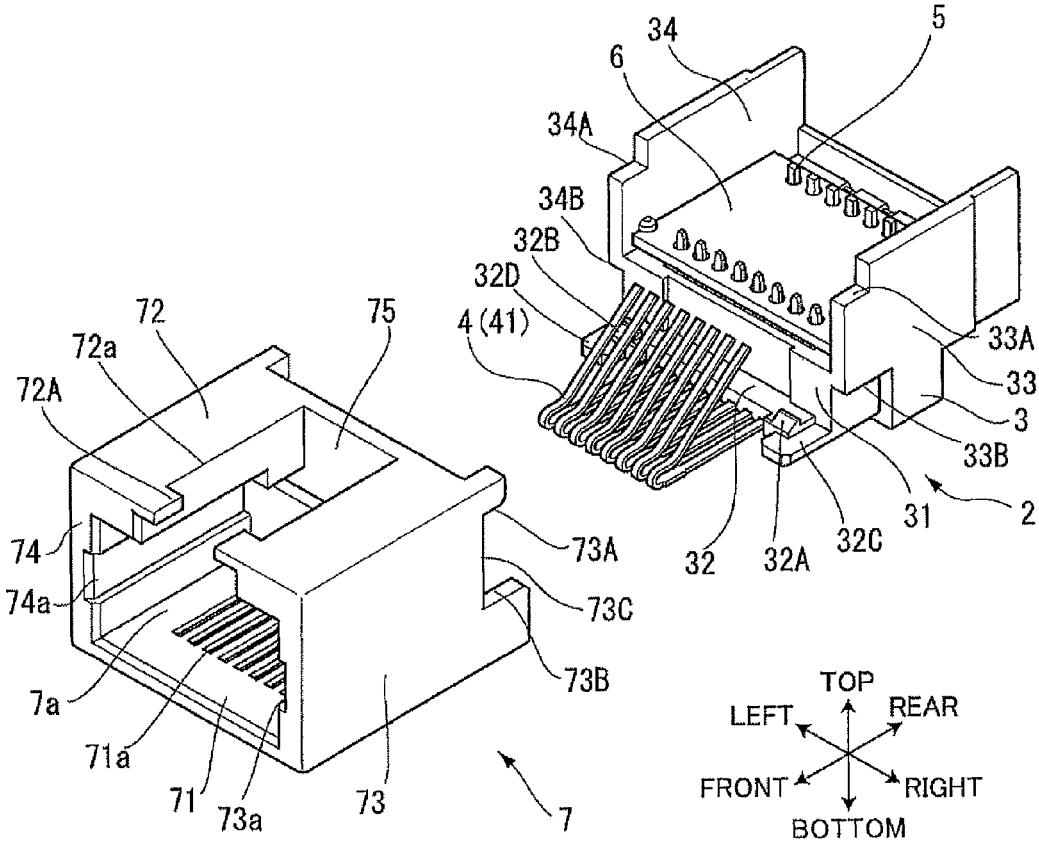
FIG. 2 is an exploded perspective view of a housing and a terminal holder in the modular jack according to the embodiment.

As shown in FIG. 2, the circuit portion 2 includes a frame 3, connector terminals 4, board terminals 5, and an internal circuit board 6. The frame 3 includes a main body 31, a terminal holding portion 32, a first side wall 33, and a second side wall 34. In the following description, a direction between the first side wall 33 and the second side wall 34 in FIG. 2 will be referred to as a "lateral direction". Further, a direction perpendicular to the frontward/rearward direction and to the lateral direction will be referred to as a "vertical direction".

As shown in FIG. 2, the main body 31 holds the connector terminal 4 and the board terminal 5, and mounts the internal circuit board 6. The main body 31 is generally box-shaped such that a side of a mounting portion that mounts the internal circuit board 6 is open.

The terminal holding portion 32 protrudes frontward from the main body 31 and extends in the lateral direction. The terminal holding portion 32 is positioned at a lower side of the main body 31.

Figure 3:
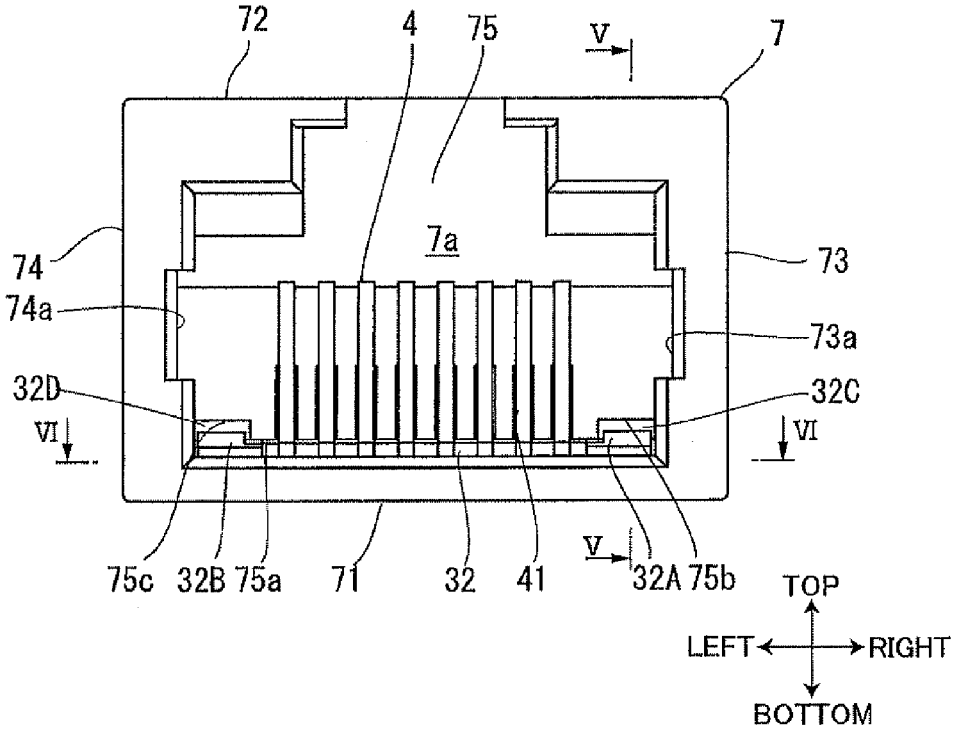
FIG. 3 is a front view of the housing in the modular jack according to the embodiment.

As shown in FIG. 3, the terminal holding portion 32 has a right side and a left side provided with a first latch section 32A and a second latch section 32B, respectively. The first latch section 32A has a shape and dimension identical to those of the second latch section 32B. More specifically, these are wedge or stepped pawl shaped and have a length in the frontward/rearward direction smaller than a thickness of a rear wall 75 (described later).

A first guide member 32C extends frontward from the main body 31 and along the first latch section 32A at a position outward of the first latch section 32A in the lateral direction. Further, a second guide member 32D extends frontward from the main body 31 and along the second latch section 32B at a position outward of the second latch section 32B in the lateral direction. The first guide member 32C has a shape and dimension identical to those of the second guide member 32D. More specifically, these are plate like shape lying in the frontward/rearward direction and the lateral direction. Further, free end of the first guide member 32C and second guide member 32D is positioned ahead of the free end of the first latch section 32A and second latch section 32B in the frontward/rearward direction.

The first side wall 33 has a shape and dimension the same as those of the second side wall 34, and only the first side wall 33 will be described. The first side wall 33 is positioned at a right end of the main body 31, and extends upward from the main body 31. Similarly, the second side wall 34 is positioned at a left end of the main body 31 and extends upward from the main body 31. The upwardly extending portions of the first side wall 33 and second side wall 34 defines a space for accommodating therein the internal circuit board 6. The first side wall 33 has a front protruding part protruding frontward. The front protruding part has a front end face extending in the vertical direction and flush with a front surface of the main body 31, an upper end face 33A and a lower end face 33B those extending in the frontward rearward direction and lateral direction. The front end face is flush with a front end surface of the main body 31.

In the connector terminals 4, eight contact terminals 41 are arrayed side by side in the lateral direction. These contact terminals 41 extends frontward from the terminal holding portion 32. The numbers, spacing, positions and configuration of these contact terminals 41 are determined based on a standard of a connector to be connected to the modular jack 1.

The board terminals 5 include eight mounting terminals 51 positioned at a rear portion of the main body 31 and suspended downward. Surf ace mounting performance of the modular jack 1 on a circuit board (not shown) can be improved by providing the board terminal 5 on the frame 3. This structure is also advantageous in that soldering between the board terminals 5 and the connector terminals 4 can be performed once, thereby improving workability.

The internal circuit board 6 is provided with a noise filter (not shown) etc., and is positioned on the main body 31 and between the upwardly extending portions of the of the first side wall 33 and second side wall 34. The internal circuit board 6 is electrically connected to the connector terminals 4 and board terminals 5. Since the internal circuit board 6 is positioned on the main body 31 and at the upwardly opened portion, access to the internal circuit board 6 can be facilitated, so that the noise filter (not shown) and other electronic parts and components can be assembled after the internal circuit board 6 is assembled to the main body 31.

The housing 7 is generally parallelepiped shape including a bottom wall 71, a top wall 72, a first side wall 73, a second side wall 74, and the rear wall 75. The top wall 72 is in confrontation with the bottom wall 71 and extends in parallel thereto. The first side wall 73 is connected to the bottom wall 71 and the top wall 72 and extends in a direction substantially perpendicular to the bottom wall 71 and the top wall 72 (in the frontward/rearward direction). The second side wall 74 is connected to the bottom wall 71 and the top wall 72 and extends in parallel to and in confrontation with the first side wall 73. The rear wall 75 is connected to the top wall 72, first side wall 73 and second side wall 74 and extends in the vertical direction. A connector accommodation space 7*a* is defined by these walls 71 through 75. A front side of the housing 7 is open. The housing 7 has a vertical length of about 10.46 mm, and the bottom wall 71 has a thick wall portion and a thin wall portion having a thickness of about 1.16 mm and about 0.5 mm, respectively.

Figure 4:
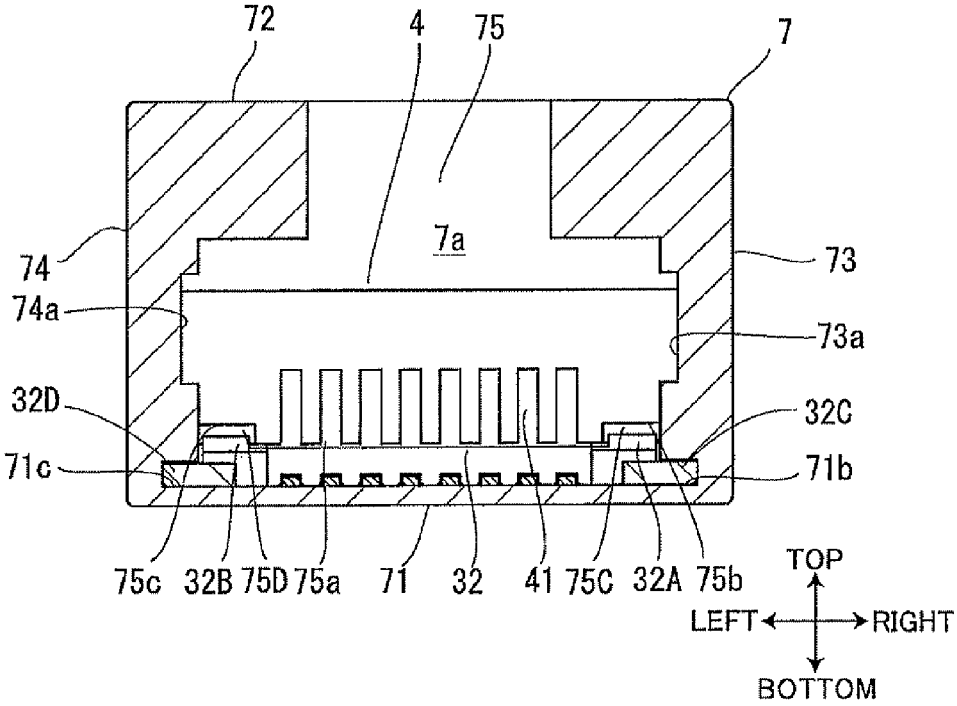
FIG. 4 is a cross-sectional view taken along a line IV-IV in FIG. 1.
Figure 5:
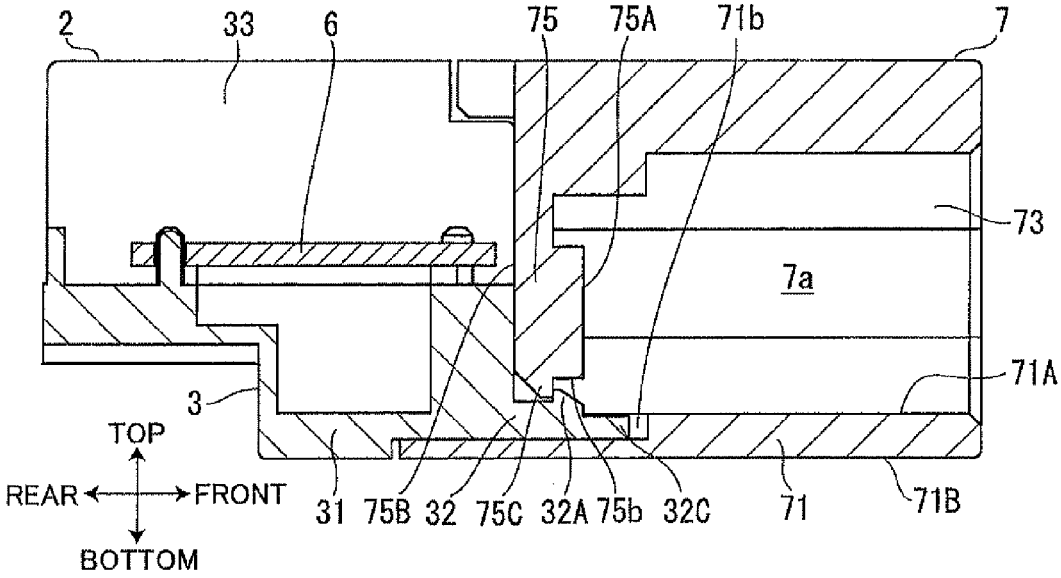
FIG. 5 is a cross-sectional view taken along a line V-V in FIG. 3.

As shown in FIG. 5, the rear wall 75 has an inner surface 75A defining the connector accommodation space 7*a*, and an outer surface 75B opposite to the inner surface 75A. As shown in FIGS. 3 and 4, a terminal insertion through-hole 75*a*, a first latch section insertion through-hole 75*b*, and a second latch section insertion through hole 75*c* are formed in the rear wall 75. These holes are open at the inner surface 75A and outer surface 75B of the rear wall 75. These through-holes 75*a*, 75*b*, 75*c* are positioned at a boundary of the bottom wall 71, i.e., a lower end portion of the rear wall 75. Further, the front end face of the main body 31 of the circuit portion 2 is in abutment with the outer surface 75B, so that frontward/rearward position of the circuit portion 2 relative to the housing 7 can be defined.

The terminal insertion through-hole 75*a* is at an intermediate position of the rear wall 75 in the lateral direction, and has a comb-like configuration including a bottom slit extending in the lateral direction and eight slits arrayed side by side in the lateral direction and extending upward from the bottom slit. With this structure, the terminal holding portion 32 can be inserted through the bottom slit and the connector terminals 4 can be inserted through the eight vertical slits.

The first and second latch section insertion through-holes 75*b*, 75*c* are positioned at right and left side of the terminal insertion through-hole 75*a*, respectively. These through-holes 75*b*, 75*c* are symmetrical with each other in the lateral direction. The first and second latch section insertion through-holes 75*b*, 75*e* are adapted to allow the first latch section 32A and second latch section 32B to be inserted therethrough.

As shown in FIGS. 3 and 5, first and second engaged portions 75C, 75D are provided on surfaces defining the first and second latch section insertion through-holes 75*b*, 75*c*, respectively. These engaged portions 75C, 75D are wedge shaped, and is positioned within the thickness of the rear wall 75. That is, these engaged portions 75C, 75D are positioned between the inner surface 75A and the outer surface 75B of the rear wall 75.

These engaged portions 75C, 75D are adapted to be engaged with the first latch section 32A and second latch section 32B, respectively. Since the length of the first and second latch sections 32A, 32B in the frontward/rearward direction is smaller than the thickness of the rear wall 75 as described above, the first and second latch sections 32A, 32B can be positioned within the thickness of the rear wall 75 while these are engaged with the first and second engaged portions 75C, 75D, respectively. In other words, in the engagement state, the first and second latch sections 32A, 32B do not protrude into the connector accommodation space 7*a* from the inner surface 75A of the rear wall 75.

The bottom wall 71 has an inner surface 71A defining the connector accommodation space 7*a*, and an outer surface 71B opposite to the inner surface 71A. The inner surface 71A is formed with a plurality of terminal insertion grooves 71*a* (FIG. 2), a first guide groove 71*b*, and a second guide groove 71*c*.

As shown in FIG. 2, the plurality of terminal insertion grooves 71*a* is positioned ahead of the terminal insertion through-hole 75*a* in the frontward/rearward direction so as to receive the connector terminals 4 when the terminal holding portion 32 is inserted through the terminal insertion through-hole 75*a*. The first and second guide grooves 71*b*, 71*c* are in communication with the first and second latch section insertion through-hole 75*b*, 75*c*, respectively, at outer side of the first and second latch section insertion through-holes 75*b*, 75*c*, respectively in the lateral direction, (outer side of the engaged portions 75C, 75D, respectively). Further, these guide grooves 71*b*, 71*c* are opened to the outer surface 75B. These guide grooves 71*b*, 71*c* are symmetrical with each other.

Figure 6:
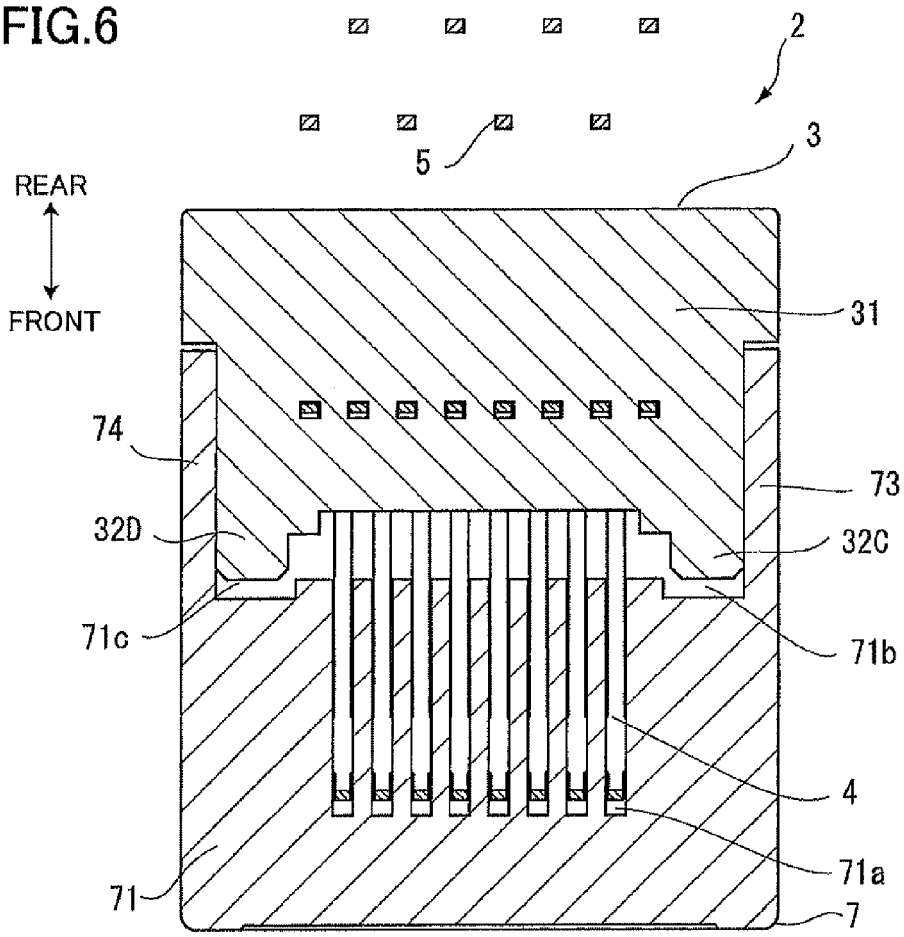
FIG. 6 is a cross-sectional view taken along a line VI-VI in FIG. 3.

As shown in FIGS. 4 and 6, the first and second guide grooves 71*b*, 71*c* have lateral end surfaces extending along or substantially flush with the lateral end surfaces of the first and second guide members 32C, 32D, respectively. Therefore, upon insertion of the first and second guide members 32C, 32D into the first and second guide grooves 71*b*, 71*c*, lateral position of the circuit portion 2 relative to the housing 7 can be easily and accurately defined. Further, as shown in FIG. 5, the first and second guide grooves 71*b*, 71*c* have groove depth which is greater than the thickness of the first and second guide members 32C, 32D in the vertical direction. This structure prevents the first and second guide members 32C, 32D from protruding upward into the connector accommodation space 7*a* from the inner surface 71A of the bottom wall 71.

Further, the bottom wall 71 has such a thickness that the first and second latch sections 32A, 32B are positioned above the inner surface 71A of the bottom wall 71.

The first and second side walls 73, 74 have shape and dimension identical to each other, and therefore, only the first side wall 73 will be described. The first side wall 73 has a rear portion positioned rearward of the outer surface 75B. The rear portion is formed with a recessed portion opened rearward. The recessed portion is U-shaped and is defined by a bottom surface 73C extending in the vertical direction, an upper surface 73A and a lower surface 37B those extending in the frontward/rearward direction. The bottom surface 73C is flush with the outer surface 75B of the rear wall 75. The recessed portion is adapted to receive the front portion of the first side wall 33 when the circuit portion 2 is assembled to the housing 7. That is, the upper surface 74A is in surface contact with the upper end face 33A of the first side wall 33, and the lower surface 73B is in surface contact with the lower end face 33B of the first side wall 33. The same is true with respect to the engagement between a recessed portion formed in the second side wall 74 and the front portion of the second side wall 34.

With this structure, vertical position of the circuit portion 2 relative to the housing 7 can be easily and accurately defined. Further, because of the engagement between the recessed portion of the housing 7 and the protruding portion of the circuit portion 2 and because of the surface contact therebetween, deformation or flex of the housing 7 and circuit portion 2 can be restrained, and generation of rattling can be avoided.

The first side wall 73 has an inner surface formed with a guide groove 73*a* that guides a connector guide portion 8A (described later) of the frame 8. The guide grooves 73*a* extends rearward from the front end of the first side wall 73. The same is true with respect to the second side wall 74.

The top wall 72 has a hole 72*a* and a stop portion 72A. A clip of the connector (not shown) is positioned in the hole 72*a* and is held by the stop portion 72A.

The frame 8 is provided by bending a metal plate. The housing 7 and the circuit portion 2 are assembled together to become an integral assembly. The frame 8 is adapted to cover front side, rear side, two lateral sides, and top side of the integral assembly. The frame 8 has a front opening 8*a* in communication with the connector accommodation space 7*a*, so that the connector (not shown) can pass through the front opening 8*a*. Further, the frame 8 has the connector guide 8A for guiding movement of the connector into the connector accommodation space 7*a*.

The connector (not shown) to be assembled to the modular jack 1 is a standardized product. There fore, the shape of the connector accommodation space 7*a* for accommodating the connector and the shape of the connector terminal 4 is standardized or uniform. With this standardized shape, dead spaces are provided at right and left sides of the connector terminal 4. In the above-described embodiment, the engaged portions 75C, 75D and the first and second latch sections 32A, 32B are provided at the dead spaces. Thus, resultant modular jack 1 can be downsized.

Various modifications are conceivable. For example, in the above-described embodiment, the free end of the first guide member 32C is positioned ahead of the free end of the first latch section 32A. Instead, the free end of the first guide member 32C can be aligned with the free end of the first latch section 32A in the frontward/rearward direction. Alternatively, the free end of the first guide member 32C can be positioned within the thickness of the rear wall 75. With such modification, the first guide member 32C does not protrude into the connector accommodation space 7*a*. (the first guide member 32C is not exposed to the connector accommodation space 7*a*). Accordingly, thinning of the first guide member 32C is not required.

Further, in the above-described embodiment, the front end face of the first latch section 32A is generally flush with the inner surface 75A of the rear wall 75. However, the front end face can be positioned more inward into the connector accommodation space 7*a* from the inner surface 75A, as long as the size of the first latch section 32A is within a tolerance of production error.

While the invention has been described in detail with reference to the specific embodiment thereof, it would be apparent to those skilled in the art that various changes and modifications may be made therein without departing from the scope of the invention.

What is claimed is:

1. A modular jack comprising:

a housing comprising a bottom wall, a top wall in confrontation with the bottom wall, a first side wall extending between the bottom wall and the top wall, a second side wall extending between the bottom wall and the top wall and in confrontation with the first side wall, and a rear wall extending between the bottom wall and the top wall and between the first side wall and the second side wall, a connector accommodation space being defined by the bottom wall, the top wall, the first side wall, the second side wall and the rear wall;

a terminal holder comprising a connector terminal including a plurality of terminals extending in parallel to each other and arrayed side by side in an arraying direction, and a latch section positioned at one end of the connector terminal in the arraying direction;

wherein the rear wall has an inner surface defining the connector accommodation space, and an outer surface opposite to the inner surface, the rear wall being formed with a terminal insertion through-hole communicating the inner surface with the outer surface, and a latch section insertion through-hole positioned beside the terminal insertion through-hole in the arraying direction and close to the one of the first side wall and the second side wall, the latch section insertion through-hole being provided with an engaged portion positioned between the inner surface and the outer surface; and wherein upon assembly of the terminal holder to the housing, the connector terminal extends through the terminal insertion through-hole and is exposed to the connector accommodation space, and the latch section is engaged with the engaged portion.

2. The modular jack as claimed in claim 1, wherein the bottom wall and the rear wall define a boundary position therebetween; and wherein the latch section insertion through-hole is positioned at the boundary portion; and wherein the bottom wall has an inward surface defining the connector accommodation space, and an outward surface opposite to the inward surface, the inward surface being formed with a guide groove communicating with the latch section insertion through-hole and open to the outward surface of the rear wall; and wherein the terminal holder further comprises a guide member inserted into the guide groove.

3. The modular jack as claimed in claim 2, wherein the latch section is positioned between the inner surface and the outer surface of the rear wall upon assembly of the terminal holder into the housing.

4. The modular jack as claimed in claim 2, wherein the guide member is positioned between the inward surface and the outward surface of the bottom wall upon assembly of the terminal holder into the housing.

5. The modular jack as claimed in claim 2, wherein the bottom wall is shaped such that the latch section protrudes toward the top wall from the inward surface of the bottom wall upon assembly of the terminal holder into the housing.

6. The modular jack as claimed in claim 1, wherein the first side wall has an abutment surface extending in an inserting direction of the terminal holder into the housing; and wherein the terminal holder has a side plate provided with an end face in abutment with the abutment surface upon assembly of the terminal holder into the housing.

7. The modular jack as claimed in claim 6, wherein the abutment surface includes a first abutment surface facing the bottom wall and a second abutment surface facing the top wall, the end face including a first end face in abutment with the first abutment surface, and a second end face in abutment with the second abutment surface.

8. The modular jack as claimed in claim 1, wherein the terminal holder further comprises a board terminal to be mounted on a circuit board.

9. The modular jack as claimed in claim 8, wherein the terminal holder further comprises an internal circuit board, the board terminal and the connector terminal being connected to the internal circuit board.

* * * * *